United States Patent [19]

Munroe

[11] Patent Number: 4,874,332

[45] Date of Patent: Oct. 17, 1989

[54] ELECTRICAL PLUGS AND CONNECTORS WITH AUTOMATIC CORD CLAMPS

[75] Inventor: Ronald G. Munroe, Hallandale, Fla.

[73] Assignee: Eagle Electric Manufacturing Co., Inc., Long Island City, N.Y.

[21] Appl. No.: 318,849

[22] Filed: Mar. 6, 1989

[51] Int. Cl.[4] ..... H01R 13/59

[52] U.S. Cl. ..... 439/462; 439/460

[58] Field of Search ..... 439/461, 462, 460, 449

[56] References Cited

U.S. PATENT DOCUMENTS 4,208,085 6/1980 Lawrence et al. ..... 439/462

FOREIGN PATENT DOCUMENTS 2829639 11/1979 Fed. Rep. of Germany ..... 439/460

3011353 10/1981 Fed. Rep. of Germany ..... 439/460

*Primary Examiner*—Gary F. Paumen

*Attorney, Agent, or Firm*—Kirschstein, Ottinger, Israel & Schiffmiller

[57] ABSTRACT

An electrical cord is clamped in a plug or connector by longitudinally moving a set of projections integral with an inner main body against a set of locking legs integral with an outer husk. The cord is circumferentially clamped within an interior compartment so as to resist removal of the cord therefrom.

12 Claims, 2 Drawing Sheets

ELECTRICAL PLUGS AND CONNECTORS WITH AUTOMATIC CORD CLAMPS

BACKGROUND OF THE INVENTION

1. Field of the Invention

This invention generally relates to electrical cord clamps for use on electrical plugs and connectors.

2. Description of Related Art

An electrical cord may be terminated in an electrical plug or cap having male-type prongs, or in an electrical connector having female-type sockets. In use, the cord may be subjected to external forces tending to pull the cord from the plug or connector. To resist such pulling forces, automatic cord clamping devices have been proposed for circumferentially clamping the cord.

In one known prior art construction, the clamping device consists of a shell into which a main body is inserted. The shell has a hole of a predetermined diameter into which the cord is inserted along a longitudinal direction or axis. The main body carries at least one electrical terminal to which the cord is connected. In the case where the cord includes hot, neutral and ground wires, three corresponding screw terminals are provided on the main body.

To achieve the clamping function, a set of movable arms extends inwardly from the main body and is arranged along an annulus whose diameter is several times greater than said predetermined diameter. A set of cams is provided within the shell. During insertion of the main body into the shell, the cams push the arms through a comparatively large distance toward said axis, thereby circumferentially clamping the cord.

However, experience has shown that the known clamping devices are not altogether satisfactory in reliably resisting forces which tend to pull the cord from the device. The known movable arms which are integrally molded with the main body have to be manually inwardly displaced toward the axis prior to inserting the body into the shell in order to reliably assemble the body inside the shell without mechanical interference therewith. This represents an extra time-consuming step in the wiring installation.

Also, the known movable arms each have to be moved through a comparatively large distance, e.g. about ½, to clamp the cord. To traverse this comparatively large distance and to enable an installer to inwardly displace the arms prior to insertion, each arm has to be readily flexible. However, by imparting a high degree of flexibility to the arms, there is no inherent tendency by the arms themselves to lock against the cord. The arms, therefore, according to the known prior art constructions, act on the cord in a non-locking manner. Hence, the known prior art clamping devices do not reliably resist cord pulls, since pulling on the cord generates a force which actually tends to open up the relatively flexible arms.

SUMMARY OF THE INVENTION

Objects of the Invention

It is a general object of this invention to overcome the aforementioned drawbacks of known automatic cord clamps for electrical plugs and connectors.

It is another object of this invention to reliably resist cord pulls and removal of the cord from an electrical plug or connector.

Still another object of this invention is to affirmatively circumferentially clamp an electrical cord.

Yet another object of this invention is to provide a cord clamp with arms which act as stiff springs and inherently press affirmatively against the cord.

A further object of this invention is to provide an automatic cord clamping device which is easier to manufacture and assemble and durable in use.

Features of the Invention

In keeping with these objects, and others which will become apparent hereinafter, one feature of this invention resides, briefly stated, in an electrical cord clamping device comprising an outer husk and an inner main body insertable into the husk to an assembled position of use. The husk has a base wall bounding a hole through which an electrical cord is insertable along a longitudinal axis. The husk also has a generally cylindrical side wall extending longitudinally away from the base wall and bounding therewith an interior compartment. The base wall has a plurality of movable, inclined, locking legs spaced around the hole about said axis and extending into the compartment from the base wall and inclined relative to, and terminating short of, said axis.

The main body has a support wall on which at least one electrical terminal for connection to the electrical cord is supported. In the case of a grounded electrical plug or connector, hot, neutral and ground terminals are provided on the support wall, each such terminal being electrically connected to hot, neutral and ground conductors of the electrical cord. The support wall has a plurality of camming projections rigid with, and extending longitudinally away from, the support wall. The projections are spaced about said axis so that each projection faces a respective leg.

The device includes locking means for longitudinally moving the main body into the interior compartment along said axis to the assembled position, and simultaneously for longitudinally moving the projections against the legs through a distance sufficient to move all the legs toward said axis and circumferentially clamp the cord within, and resist removal of the cord from, the interior compartment.

Preferably, the husk and the legs are integrally molded of a common electrically insulating synthetic plastic material, and the main body and the projections are separately or in the same mold integrally molded of a common electrically insulating synthetic plastic material.

The husk further includes a plurality of inclined wire guides spaced about said axis. The wire guides extend from the base wall along said transverse direction into the compartment, and serve to guide the wire into the interior compartment.

The husk still further includes a plurality of longitudinally-extending tracks at an inner circumferential surface of the side wall. Each projection is slidingly received in a respective track during insertion of the main body into the husk. A longitudinally-extending key is provided at the inner circumferential surface of the husk, the key being received in a keyway provided on the main body.

The locking means includes at least one, and preferably a pair of, threaded fasteners carried by the main body, and operative for threadedly engaging threaded passages formed in the husk. By turning the fasteners in the threaded passages, the main body is longitudinally advanced into the interior compartment of the husk.

During this movement, the projections engage the legs and push them against their inherent resilience closer together in a locking action against the cord inserted into the interior compartment. Should a large diameter cord be assembled, then the number of turns required to tighten the assembly would be fewer as compared to the situation where a smaller diameter cord were to be assembled.

The novel features which are considered as characteristic of the invention are set forth in particular in the appended claims. The invention itself, however, both as to its construction and its method of operation, together with additional objects and advantages thereof, best will be understood from the following description of specific embodiments when read in connection with the accompanying drawings.

Figure 1:
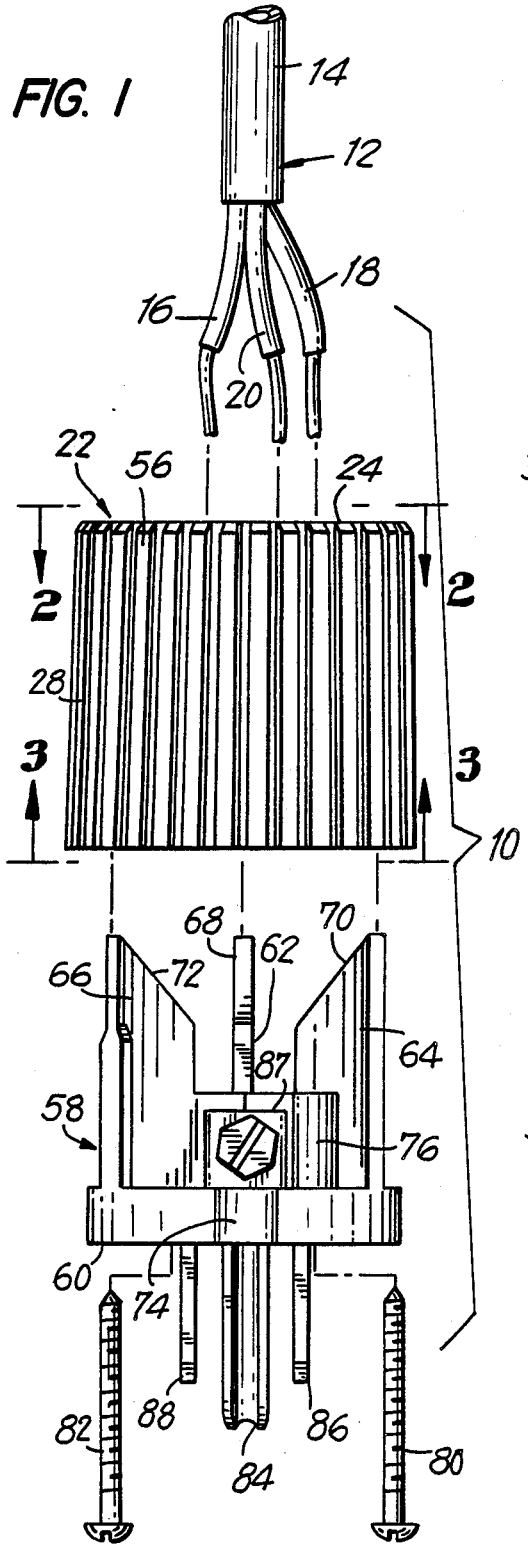
FIG. 1 is an exploded side view of a cord clamping plug according to this invention.
Figure 2:
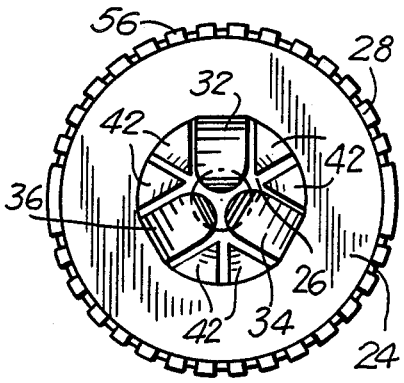
FIG. 2 is a top sectional view taken on line 2—2 of FIG. 1.
Figure 3:
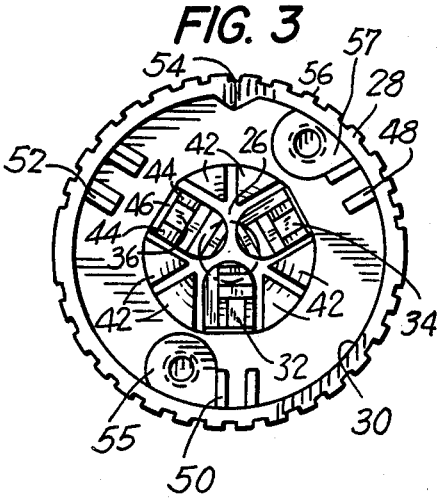
FIG. 3 is a bottom sectional view taken on line 3—3 of FIG. 1.

The cord 12 is shown as having a jacket 14 encasing three electrical wires, i.e. a hot wire 16, a neutral wire 18 and a ground wire 20. This invention is not intended to be limited to three-wire cables for attachment to grounded plugs or to grounded connectors, since more or fewer than three wires in the cable are also within the scope of this invention.

The amperage and voltage rating of the cord can be selected as desired, in which case, the diameter of the cord varies as a function of such electrial rating and of the number of wires within the cord.

Figure 5:
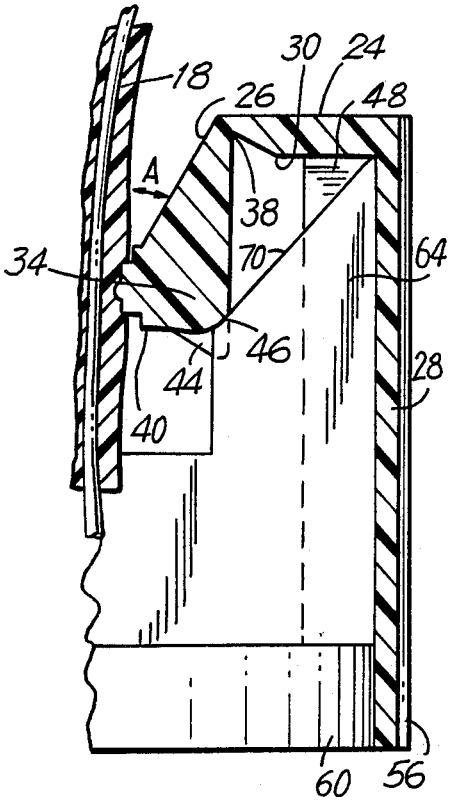
FIG. 5 is an enlarged sectional view taken on line 5—5 of FIG. 4.
Figure 6:
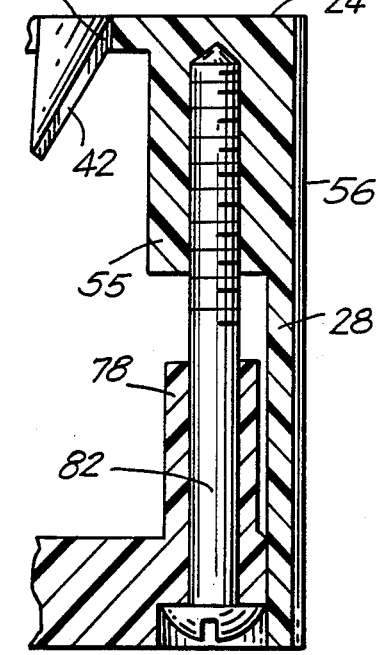
FIG. 6 is an enlarged sectional view taken on line 6—6 of FIG. 4.

An outer husk 22 constituted of electrically insulating synthetic plastic material has a planar base wall 24 bounding a hole 26 through which the cord 12 is insertable along a longitudinal direction or axis, and a generally cylindrical side wall or skirt 28 extending longitudinally away from the base wall and bounding therewith an interior compartment 30. The base wall 24 has a plurality of movable, inclined, locking legs 32, 34, 36 equiangularly arranged about the hole 26 about said axis. The legs extend into the compartment 30 from the base wall along a transverse direction inclined relative to, and terminating short of, the axis. The legs terminate in free ends or tips 40. As shown in FIG. 5 for representative leg 34, each leg is integrally molded with the husk, and is pivoted about reduced thickness portion or hinge 38 in the direction of double-headed, curved arrow A. In a preferred embodiment, the hinges 38 are located on an annulus having a diameter of about ½", while the tips 40 bound therebetween a space whose maximum dimension is on the order of ⅛". The legs, therefore, bound a frusto-conical volume in space.

Each leg is, in effect, a stiff spring. When cords greater than ⅛" in diameter are inserted, the legs are pushed aside during such insertion and automatically seek to return to their initial positions, thereby circumferentially clamping the cord, at least to some extent. When cords smaller than ⅛" in diameter are inserted, the legs have to be affirmatively pushed against their inherent resilience toward the axis and toward each other to constrict the size of the space. As described below, this pushing action is performed by locking means which engage engagement surfaces 46 provided on the free end 40 of each leg. Each engagement surface 46 is bounded by side extensions 44 extending past opposite sides of each engagement surface 46 and forming therewith a U-shaped channel.

A plurality of inclined wire guides 42 are also spaced around the hole 26, and extend from the base wall along said transverse direction into interior compartment 30. The wire guides 42 are located between adjacent legs. As shown in the drawings, two wire guides, each of triangular configuration, are located between each pair of neighboring legs. More or fewer than two guides can be so positioned. The function of all the wire guides is to guide the cord between the legs and past the free ends 40 thereof into the interior compartment with minimal mechanical interference. The guides are also integrally molded with the husk and are inwardly yieldable to accommodate large diameter cords. Less pressure is needed to deflect the guides as compared to that needed to displace the relatively stiffer legs.

The husk has an inner circumferential surface along which a plurality of longitudinally-extending tracks 48, 50, 52 extend. The tracks are angularly spaced about said axis, and extend from the base wall 24 toward, but terminating short of, the open end of the husk. A key 54, preferably of triangular cross-section, also extends longitudinally along the inner circumferential surface of the husk. A pair of tubular threaded mounts 55, 57 are also provided within the husk, each having a hole of such diameter to interfere with a complementary thread-cutting fastener.

The aforementioned husk, legs, guides, tracks, key and fastener mounts are all integrally molded in a one-piece construction. The outer circumferential surface of the husk is grooved with longitudinal ribs 56, not only to rigidify the husk, but also to enable an electrician to gain a better manual grip on the husk to assist him or her in the wiring of the cord to the device.

Figure 4:
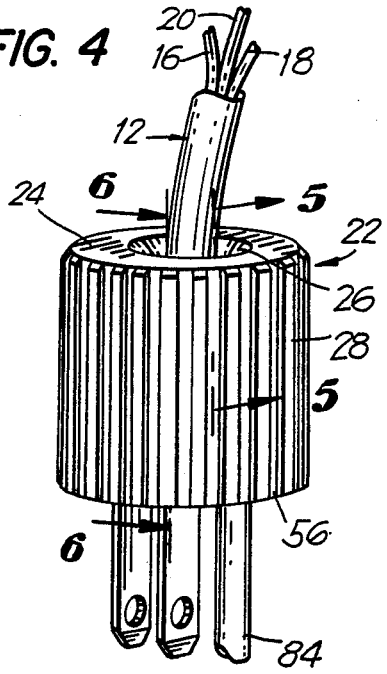
FIG. 4 is a perspective view of the assembled plug of FIG. 1.

Returning to FIG. 1, an inner main body 58 is insertable into the compartment 30 along the longitudinal direction to an assembled position of use (see FIG. 4). The body 58 includes a planar support wall 60 and a plurality of camming projections 62, 64, 66 molded rigid with, and extending longitudinally away from, the support wall 60. The projections are equiangularly spaced about said axis so that each projection faces a respective leg. More particularly, projections 62, 64, 66 are each provided with inclined abutment surfaces 68, 70, 72, each of which extends along said transverse direction.

A keyway 74 of complementary configuration to that of the triangular key 54 extends longitudinally along the support wall 60. A pair of tubular holders 76, 78 are integrally formed, and extend longitudinally along said axis, on the body 58. The holders have clearance passages extending therethrough for receiving with clearance threaded fasteners 80, 82. A small portion of each tubular holder has interference with each fastener to hold the fastener in place prior to assembly.

In order to insert the body 58 into the compartment 30 of husk 22, the key 54 must first be aligned with keyway 74. This automatically aligns the projections 62, 64, 66 in tracks 50, 48, 52. Insertion of the body into the husk causes the projections to slide along their respective tracks until the abutment surfaces 68, 70, 72 engage the engagement surfaces 46 of the legs. The side extensions 44 prevent the abutment surfaces from shifting off the engagement surfaces. The wire 12 has previously been inserted into the compartment 30 and connected to screw terminals, as described in detail below. The fasteners 80, 82 pass with clearance through the clearance passages of holders 76, 78 and cut threaded passages in mounts 55, 57. By turning the threaded fasteners 80, 82, the body 58 is drawn further into the husk 22. At the same time, the inclined abutment surfaces 68, 70, 72 push the legs toward each other toward said axis and circumferentially clamp the wire 12 within the interior compartment. Should a large diameter wire be assembled, then the number of turns required to tighten the assembly would be fewer, and the main body would telescope into the husk a shorter distance because the legs are required to be moved through a shorter distance in order to firmly lock the wire in place. Should a smaller diameter wire be used, the arms would have to be moved toward the axis into the wire a greater distance and, therefore, the main body telescopes into the husk a greater distance.

In the case where the device is an electrical plug or cap, then the main body supports a plurality of male-type prongs 84, 86, 88, including a ground prong 84 and two power prongs 86, 88. Each prong extends through the support wall 60 and makes electroconductive contact with a respective screw to which an exposed end of each of the wires 16, 18, 20 is connected, e.g. by inserting the exposed end between a clamp plate 87 and the prong 84, 86 or 88.

Figure 7:
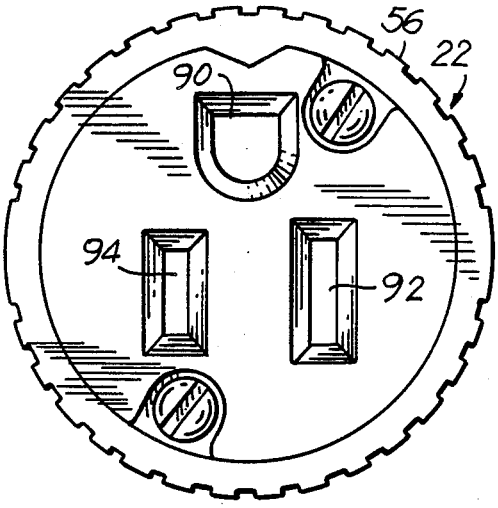
FIG. 7 is an enlarged top view of a cord clamping connector according to this invention. DETAILED DESCRIPTION OF THE PREFERRED EMBODIMENTS Referring to FIG. 1, reference numeral 10 generally identifies the electrical termination of an electrical cord or cable 12 to a clamping device which can be either an electrical plug or cap having male-type prongs as depicted in the embodiment of FIGS. 1–6, or an electrical connector having female-type sockets as depicted in FIG. 7.

In the case where the device is an electrical connector, then, rather than extending male-type prongs through the support wall 60, a plurality of female-type sockets 90, 92, 94 extend through the support wall. This situation is shown in FIG. 7. Each socket makes electrical contact with a respective screw terminal carried by the main body in an analogous manner to that described earlier for the plug.

The main body, legs and holders are all integrally molded in a one-piece construction. The projections 64, 66, 68 are strong enough to readily displace the arms to circumferentially clamp the wire and resist its removal from the interior compartment.

In the preferred embodiment, the locking legs 32, 34, 36 grip the cord independently of the action of the camming projections. Husk 22 is thus held in place during the termination phase of the assembly.

It will be understood that each of the elements described above, or two or more together, also may find a useful application in other types of constructions differing from the types described above.

While the invention has been illustrated and described as embodied in electrical plugs and connectors with automatic cord clamps, it is not intneded to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention and, therefore, such adaptations should and are intended to be comprehended within the meaning and range of equivalence of the following claims.

What is claimed as new and desired to be protected by Letters Patent is set forth in the appended claims.

1. An electrical cord clamping device, comprising:

(a) an outer husk having a base wall bounding a hole through which an electrical wire is insertable along a longitudinal axis, and a generally cylindrical side wall extending longitudinally away from the base wall and bounding therewith an interior compartment, said base wall having a plurality of movable, inclined, locking legs unitary therewith spaced around the hole about said axis and extending into the compartment from the base wall and inclined relative to, and terminating short of, said axis;

(b) an inner main body insertable into the interior compartment along said axis to an assembled position of use, said main body having a support wall on which at least one electrical terminal for connection to the electrical wire is supprted, said support wall having a plurality of camming projections rigid with, and extending longitudinally away from, the support wall and spaced about said axis so that each such projection faces a respective said leg; and (c) locking means for longitudinally moving the main body into the interior compartment to the assembled position, and for longitudinally moving the projections against the legs to move all the legs toward said axis and circumferentially clamp the wire within, and resist removal of the wire from, the interior compartment.

2. The cord clamping device according to claim 1, wherein the legs and projections are equiangularly spaced about said axis.

3. The cord clamping device according to claim 2, wherein the base wall has a plurality of inclined wire guides spaced around the hole about said axis and extending from the base wall along said transverse direction into the compartment, said wire guides being located between adjacent legs.

4. The cord clamping device according to claim 1, wherein the husk and the legs are integrally molded of a common electrically insulating, synthetic plastic material, and wherein the main body and the projections are integrally molded of a common electrically insulating, synthetic plastic material.

5. The cord clamping device according to claim 1, wherein the husk has a plurality of longitudinally-extending tracks at an inner circumferential surface of the side wall, and wherein each said projection is slidingly received in a respective track during movement of the main body relative to the husk.

6. The cord clamping device according to claim 1, wherein the husk has a longitudinally-extending key at an inner circumferential surface of the side wall, and wherein the support wall has a keyway for receiving the key during movement of the main body relative to the husk.

7. The cord clamping device according to claim 1, wherein the locking means includes at least one passage on the husk, and at least one threaded fastener on the main body, said fastener cutting a thread in the passage during operation of the locking means.

8. The cord clamping device according to claim 1, wherein each said locking leg has wall portions bounding a channel in which a respective said projection is received.

9. The cord clamping device according to claim 1, wherein the support wall and the base wall lie in generally parallel planes in the assembled position.

10. The cord clamping device according to claim 1, wherein two power prongs and a ground prong extend through, and are supported by, the support wall.

11. The cord clamping device according to claim 1, wherein two power sockets and a ground socket are supported by the support wall.

12. The cord clamping device according to claim 1, wherein the locking legs grip the wire independently of the action of the locking means.

* * * * *